US010328694B2

(12) United States Patent
Chen et al.

(10) Patent No.: US 10,328,694 B2
(45) Date of Patent: Jun. 25, 2019

(54) PRINTED CIRCUIT BOARD WITH RECESSED POCKET FOR FLUID DROPLET EJECTION DIE

(71) Applicant: HEWLETT-PACKARD DEVELOPMENT COMPANY, L.P., Houston, TX (US)

(72) Inventors: Chien Hua Chen, Corvallis, OR (US); Diane R Hammerstad, Corvallis, OR (US); Randy Hoffman, Corvalls, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/556,871

(22) PCT Filed: Jul. 31, 2015

(86) PCT No.: PCT/US2015/043080

§ 371 (c)(1),
(2) Date: Sep. 8, 2017

(87) PCT Pub. No.: WO2017/023241

PCT Pub. Date: Feb. 9, 2017

(65) Prior Publication Data

US 2018/0170050 A1 Jun. 21, 2018

(51) Int. Cl.
*B41J 2/14* (2006.01)
*B41J 2/16* (2006.01)

(52) U.S. Cl.
CPC ..... *B41J 2/14072* (2013.01); *B41J 2/1433* (2013.01); *B41J 2/14129* (2013.01); *B41J 2/14145* (2013.01); *B41J 2/1623* (2013.01); *B41J 2/1637* (2013.01); *B41J 2002/14419* (2013.01); *B41J 2002/14491* (2013.01); *B41J 2202/13* (2013.01); *B41J 2202/18* (2013.01)

(58) Field of Classification Search
CPC ..... B41J 2/14072; B41J 2/14129; B41J 2/14145; B41J 2/1623
See application file for complete search history.

(56) References Cited

U.S. PATENT DOCUMENTS

| | | | | |
|---|---|---|---|---|
| 5,148,595 | A | 9/1992 | Doggett et al. | |
| 6,554,399 | B2 | 4/2003 | Wong et al. | |
| 7,438,388 | B2 | 10/2008 | Silverbrook et al. | |
| 2002/0051036 | A1 | 5/2002 | Scheffelin et al. | |
| 2002/0060715 | A1 * | 5/2002 | Karita | B41J 2/14016 347/42 |
| 2005/0057605 | A1 | 3/2005 | Silverbrook et al. | |
| 2006/0132543 | A1 | 6/2006 | Elrod et al. | |
| 2009/0201342 | A1 | 8/2009 | Silverbrook et al. | |
| 2011/0069120 | A1 * | 3/2011 | Bhowmik | B41J 2/14145 347/44 |
| 2011/0134192 | A1 | 6/2011 | Furukawa et al. | |

(Continued)

FOREIGN PATENT DOCUMENTS

| | | | |
|---|---|---|---|
| WO | WO2014133660 | | 9/2014 |
| WO | wo2014133660 | A1 * | 9/2014 |

*Primary Examiner* — Jason S Uhlenhake
(74) *Attorney, Agent, or Firm* — HP Inc. Patent Department

(57) ABSTRACT

A printed circuit board includes a recessed pocket. A fluid droplet ejection die is within recessed pocket.

11 Claims, 3 Drawing Sheets

(56) References Cited

U.S. PATENT DOCUMENTS

| | | | | |
|---|---|---|---|---|
| 2014/0092171 | A1 | 4/2014 | Anderson et al. | |
| 2016/0009086 | A1* | 1/2016 | Choy | B41J 2/14 347/50 |

* cited by examiner 524
526
590
530
586
566
560
568

528
563
527
591
526
32
590
591
527
586
563
530
566
560
568

620
532
530
530
530
624

528
527
526
580
527
592
590
528
586
527
566
560
568

720
732
730
40
724

720
528
527
526
680
528
527
792
526
528
680
526
527
720
40
724
732

620
526
527
528
680
527
526
508
680
528
527
532
526
680
40
692
624

PRINTED CIRCUIT BOARD WITH RECESSED POCKET FOR FLUID DROPLET EJECTION DIE

BACKGROUND

Fluid droplet ejection printing typically relies upon fluid droplet ejection dies by which droplets of fluid are selectively ejected onto a medium. Control of the fluid ejection may be facilitated using a circuit chip that transmits signals to each fluid droplet ejection die.

DETAILED DESCRIPTION OF EXAMPLES

Figure 1:
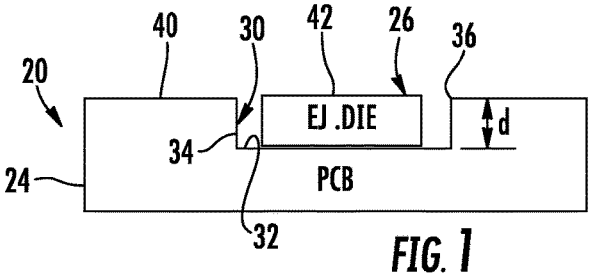
FIG. 1 is a sectional view schematically illustrating an example print head.

FIG. 1 schematically illustrates an example fluid droplet ejection print head 20. As will be described hereafter, fluid droplet ejection print head 20 utilizes a printed circuit board as a support for an fluid droplet ejection die. The printed circuit board includes a recessed pocket in which the die is located such that the die is less proud. As a result, planarity of the print head is enhanced. Enhanced planarity of the printed may facilitate enhanced servicing of the print head dies. In another example, media (Paper/powder) to printhead spacing may be reduced.

Print head 20 comprises printed circuit board 24 and fluid droplet ejection die 26. Printed circuit board (PCB) 24 comprises a platform that mechanically supports electronic components using conductive tracks or traces, pads and other features. In one implementation, printed circuit board 24 comprises a nonconductive substrate upon which an electrically conductive sheet is laminated and etched or otherwise patterned to form tracks or traces, pads and other features. In one implementation, the electrically conductive sheet comprises a sheet of copper. In one implementation, printed circuit board 24 comprises multiple layers or laminations of nonconductive substrates and electrically conductive traces.

In one implementation, printed circuit board 24 comprises a fire retardant 4 (FR4) printed circuit board, wherein FR4 is a glass fiber epoxy laminate. In one implementation, the glass fiber epoxy laminate comprises core layers comprising a glass fiber reinforcement material embedded in an epoxy resin matrix upon which electrically conductive traces are formed, wherein the core layers are laminated to one another by intermediate prepreg layers, epoxy coated glass fabric layers.

In yet other implementations, printed circuit board 24 may be formed from other core materials which are laminated to one another using other glues, adhesives or epoxies. For example, in another implementation, printed circuit board 14 may comprise a composite epoxy material (OEM) printed circuit board, wherein the glass fiber fabric layers or cores are laminated to one another by a laminated paper.

As further shown by FIG. 1, printed circuit board 24 comprises a recessed pocket 30 having a floor 32, sides 34 and a mouth 36. Pocket 30 forms a cavity, volume or recess that extends into printed circuit board 24 from face 40 of printed circuit board 24. Pocket 30 is sized to at least partially receive fluid droplet ejection die 26. In the example illustrated, pocket 30 has a depth d greater than or equal to a thickness of die 26. In one implementation, pocket 30 has a depth d of at least 150 μm.

In one implementation, pocket 30 extends into and is contained within a single topmost layer of printed circuit board 24. For example, in one implementation, pocket 30 extends to the topmost cover layer which is not contact and underlie an electrically conductive trace, such as a layer of prepreg. In one implementation, pocket 30 extends through the topmost cover layer so as to expose an electrically conductive trace or electrical contact pad provided on an underlying core layer of printed circuit board 24. In yet another implementation, pocket 30 extends through a topmost cover layer and further into an underlying core layer.

Fluid droplet ejection die 26 comprises a printing element by which droplets fluid, such as ink, are selectively ejected or fired through corresponding nozzles. In one implementation fluid droplet ejection die 26 comprises an arrangement of firing chambers that are proximate to corresponding nozzles, wherein drop ejectors are located within such firing chambers. In one implementation, such drop ejectors comprise thermal fluid droplet ejection resistors that are supplied with electric current to generate sufficient heat to vaporize or nucleate adjacent fluid within the corresponding firing chamber so as to create a bubble, wherein the bubble forcefully ejects a drop or drops of fluid through the corresponding nozzle. In yet other implementations, die 26 may support other types of drop ejectors such as piezo-resistive drop ejectors, wherein a flexible diaphragm is moved to eject a drop or drops of fluid through a corresponding nozzle.

As shown by FIG. 1, die 26 is at least partially received within pocket 30. Die 26 is supported by floor 32 of pocket 36. Unless otherwise specifically noted, recitations that a die is "supported" by the floor encompasses both the die being directly supported by the floor, in contact with the floor, and the die being indirectly supported by the floor, with one or more intermediate structures or materials sandwiched between the floor and the die.

In the example illustrated, die 26 is supported by the floor 32 with a an outer face 42 of the die 26 extending substantially coplanar or substantially flush with face 40 of printed circuit board 24. The term "substantially coplanar" or "substantially flush" means that the outermost face of the die and the outermost face of the print head extend within planes that are coplanar with one another or within a spacing or distance of +/−20 um from one another with either the die rising above or being proud with respect to the outermost surface of the print head or the outermost surface of the print head rising above the outer more surface of the die. The outermost face of a die means the surface of die 42 closest to the print medium during printing. Likewise, the outermost face of a printed circuit board means the surface of the printed circuit board (excluding electronic devices or componentry supported by the printed circuit board) closest to the print medium during printing. In circumstances where the outermost faces of the die or the print head are irregular (not flat or planar all across the printed circuit board), the outermost face of the print head refers to the height of the tallest projections (excluding electronic devices or componentry supported by the printed circuit board) rising from the face, such as the height of electrical traces (or their coverings) or contact pads rising above the face. In such an implementation, because face 42 and face 40 are substantially coplanar or substantially flush with one another, servicing of print head 20 may be enhanced.

Figure 2:
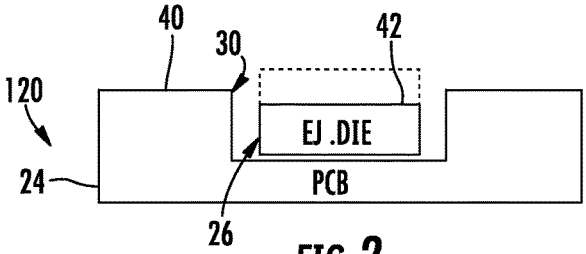
FIG. 2 is a sectional view schematically illustrating another example print head.

As schematically illustrated by FIG. 2 which illustrates print head 120, in other implementations, fluid droplet ejection die 26 may be positioned within a pocket 30 and supported by floor 32 such that surface 42 of fluid droplet ejection die 26 is not substantially flush or not substantially coplanar with the outer face 40 of printed circuit board 24. As illustrated by FIG. 2, in one implementation, the outermost face 42 of die 26 may be recessed within pocket 30 relative to outermost face 40 of printed circuit board 24. In some implementations, such recessing of die 26 provides additional height or volume within pocket 30 for electrical connectors that connect die 26 to printed circuit board 24 as well as covering layers, such as an encapsulating layer that encapsulates such electric connectors.

Alternatively, as indicated by broken lines in FIG. 2, in some implementations, outermost face 42 of die 26 may project beyond pocket 30 and beyond outermost face 40. In such an implementation, although surface 42 remains proud with respect to surface 40, the extent to which surface 42 is proud with respect to printed circuit board 24 and its outermost surface 40 is reduced.

Figure 3:
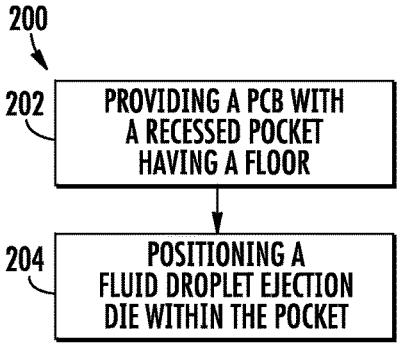
FIG. 3 is a flow diagram of an example method for forming the printed of FIG. 1 or the print head of FIG. 2.

FIG. 3 is a flow diagram of an example method 200 for forming a print head, such as print head 20. As indicated by block 202, a printed circuit board (PCB) with a recessed pocket having a floor, such as printed circuit board 24, is provided. In one implementation, the pocket is molded into one or more of the layers of the printed circuit board during its fabrication. In yet another implementation, the pocket is formed by performing material removal processes on the printed circuit board. For example, the pocket 30 may be formed by routing a recess into printed circuit board 24. In one implementation, the depth of the pocket is controlled to control the relative positioning of the outermost surfaces of the die and the printed circuit board.

In one implementation, the depth of the pocket 30 may not be precisely controlled, possibly due to the process by which the pocket 30 is formed. In such a circumstance, the pocket 30 may be provided with a depth greater than a thickness of the die 26, wherein additional structures or materials, such as a spacer, shim, glue, epoxy or the like, are provided along the floor of the pocket or are provided to the underside of the die 26 to control or adjust the relative positioning of the outermost surface 42 of the die 26 and the printed circuit board 24.

As indicated by block 204, die 26 is positioned upon floor 32. In one implementation, die 26 is positioned directly upon floor 32 in which die 26 contacts floor 32. In yet another implementation, additional materials, substances or structures are sandwiched between floor 32 and the opposite surface of die 26. For example, in one implementation, an epoxy or glue may be applied to either or both of the mutually facing surfaces of die 26 and floor 32. In one implementation, a shim or spacer, or multiple shims and spacers, may rest upon floor 32 to raise die 26 within pocket 34, may be bonded to floor 32 or may be bonded or otherwise secured to die 26.

In some implementations, the shim or spacer may be compressible or resiliently compressible. In such an implementation, die 26 may compress the shim or spacer, wherein once positioned at a desired height or level of planarity with respect to outermost surface 40 of printed circuit board 24 and while the shim or spacer is compressed, die 26 is retained at the selected height, such as with glue, epoxy, molding compound or the like.

Figure 4:
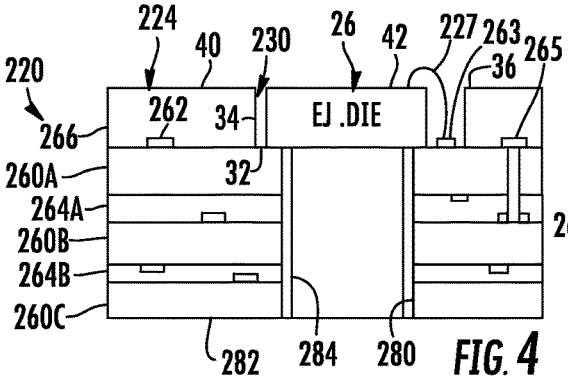
FIG. 4 is a sectional view schematically illustrating another example print head.

FIG. 4 schematically illustrates print head 220, an example of print head 20. Print head 220 comprises printed circuit board 224, fluid droplet ejection die 26 (described above) and electrical interconnect 27. Printed circuit board 224 is similar to printed circuit board 24 except that printed circuit board 224 is specifically illustrated as comprising multiple laminated layers comprising core layers 260A, 260B, 260C (collectively referred to as core layers 260), traces 262, contact pad 263, binding layers 264A, 264B (collectively referred to as binding layers of 264), electrically conductive vias 265 (one of which is shown) and topmost cover layer 266.

Core layers 260 comprise dielectric layers upon which are formed or patterned electrically conductive traces 262. In one implementation in which printed circuit board 224 comprises an FR4 printed circuit board, core layers 260 comprise a glass fiber fabric and epoxy resin matrix. Although FIG. 4 illustrates three core layers and two intermediate binding layer 264 for ease of illustration, in other implementations, printed circuit board 224 may comprise additional or fewer core layers 260 and associated traces 262 as well as additional binding layers 264.

Traces 262 are formed from metals, such as copper. In one implementation, traces 262 are formed by etching a copper sheet plated upon core layers 260. Binding layers 264 comprise layers that join core layers 260 and encapsulate traces 262. In one implementation in which printed circuit board 224 comprises an FR4 printed circuit board, binding layers 260 comprise prepreg, an epoxy coated glass fabric. In other implementations, binding layer 264 may comprise a laminated paper such as with a OEM printed circuit board.

Electrically conductive via 265 extends through core layers 260 and provides electrical connection between electrically conductive traces 262 of different layers 460. In one implementation, electrically conductive via 265 is formed by drilling through layers 260, 264 and plating copper within such drilled apertures.

Cover layer 266 comprises a layer of material or multiple layers of material that overlie the uppermost core layer 260A and its electrical traces 262. Cover layer 266 omits the electrical traces or electrical contact pads. In one implementation, cover layer 226 comprise the same material forming binding layers 264. In one implementation, cover layer 226 comprises an epoxy or an epoxy coated glass fabric such as prepreg.

As further specifically shown by FIG. 4, print head 220 comprises pocket 230 and fluid passage 280. Pocket 230 is similar to pocket 30. Pocket 230 includes floor 32, sides 34 and mouth 36. Pocket 230 contains die 26. In the example illustrated, die 26 directly contacts floor 32 of pocket 230 or is adhesively bonded to the floor 32 of pocket 230.

In the example illustrated, floor of pocket 230 overlies core layer 260A such that pocket 230 does not project into or extend into core layer 260A. Pocket 230 exposes electrical contact pad 263 supported by core layer 260A, facilitating the connection of the electrical interconnect 227, a wire or flexible circuit, to contact pad 263 and to die 26. Although not illustrated, in some implementations, electrical interconnect 227 may itself be covered or coated by a protective layer or layers.

Fluid passage 280 extends through printed circuit board 224 from a back face 282 opposite to face 40. Fluid passage 280 provides a passage by which fluid, such as ink, may be supplied from face 282 through printed circuit board 224 to slots, manifold or other fluid delivery passages of die 26. In the example illustrated, fluid passage 280 extends through and across core layers 260 and binding layers 264. In such an implementation, surfaces along fluid passage 280 are coated with a barrier layer 284 to inhibit diffusion or seepage of fluids between the layers of printed circuit board 224. In other implementations, a fluid directing tube or liner may be inserted into fluid passage to direct fluid to die 26. In other implementations, one of layers 260, 264 may continuously or homogenously extend upwards and/or downwards across the other layers 260, 264 from face 282 to floor 32 of pocket 230, wherein fluid passage 280 is formed through the one layer, reducing or eliminating the number of lamination junctions or layer junctions along fluid passage 280.

Figure 5:
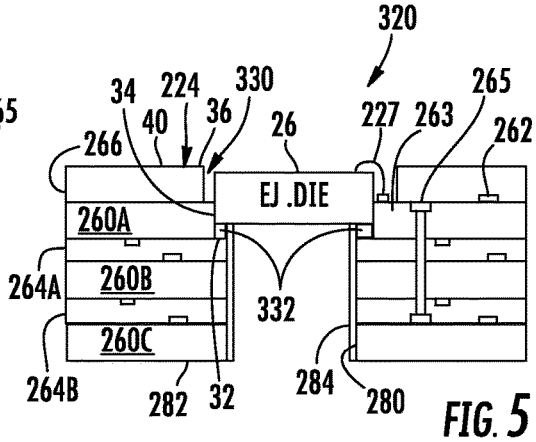
FIG. 5 is a sectional view schematically illustrating another example print head.

FIG. 5 schematically illustrates print head 320, another implementation of print head 20. Print head 320 is similar to print head 220 except that printed circuit board 224 comprises pocket 330 in place of pocket 230 and additionally comprises spacer 332. Those remaining structures of print head 320 which correspond to structures of print head 220 are numbered similarly.

Similar to pocket 230, pocket 330 comprises floor 32, sides 34 and mouth 36. Unlike pocket 230, pocket 330 extends from outermost face 40 through multiple layers or laminations a printed circuit board 224. In the example illustrated, pocket 230 extends through both cover layer 266 and core layer 260A, wherein floor 32 overlies binding layer 264A.

Spacer 332 comprises a structure that serves as a shim, elevating or spacing die 26 with respect to floor 32. In one implementation, spacer 332 comprises a series of individual spacing elements. In another implementation, spacer 332 comprises a ring. In yet another implementation, spacer 332 comprises the rim of a filter that extends across fluid passage 280, filtering fluid as it passes from fluid passage 280 to die 26. In one implementation, spacer 332 is provided as part of a tube or liner extending along fluid passage 280.

In one implementation, spacer 332 is compressible or resiliently compressible. In such an implementation, die 26 may compress the shim or spacer, wherein once positioned at a desired height or level of planarity with respect to outermost surface 40 of printed circuit board 224 and while the shim or spacer 332 is compressed, die 26 is retained at the selected height, such as with glue, epoxy, molding compound or the like.

Figure 6:
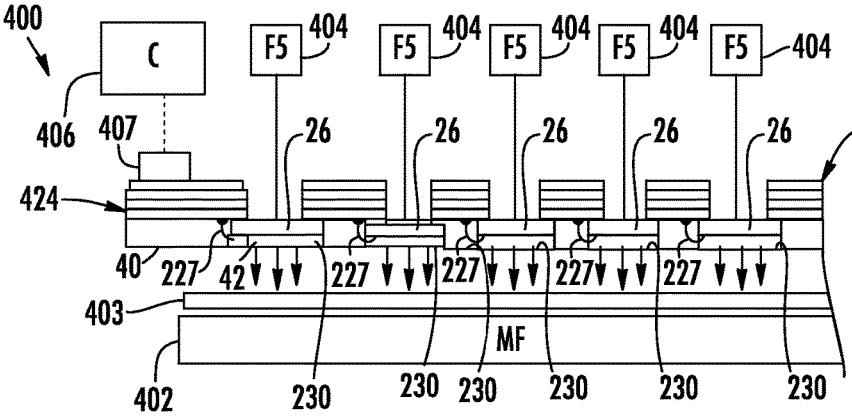
FIG. 6 is a schematic diagram of an example printing system.

FIG. 6 is a sectional view schematically illustrating an example printing system 400 which utilizes an implementation of any of print heads 20, 120, 220 or 320 described above. Printing system 400 comprises media feed 402, fluid supplies 404, controller 406 and print bar 408. Media feed 402 comprises a device to move media, such as sheets or webs of paper, into position for being printed upon by print bar 408. In one implementation, media feed 402 comprises one or more rollers by which sheets or webs of media 403 are driven and moved relative to print bar 408.

Fluid supplies 404 supply fluid, such as ink, to different fluid droplet ejection dies that are part of print bar 408. In one implementation, fluid supplies 404 supply different types of fluid to their respective dies. For example, in one implementation, fluid supplies 404 supply black, cyan, magenta and yellow inks to their respective associated dies. In one implementation, fluid supplies 404 are carried by print bar 408. In another implementation, fluid supplies 404 are "off-axis", located remote with respect to print bar 408, wherein fluid is supplied through one or more conduits.

Controller 406 comprises electronics that output control signals controlling the ejection of the fluid from each of the dies on print bar 408. In the example illustrated, controller 406 outputs electric control signals which are transmitted to a processor chip 407, such as an application-specific integrated circuit (ASIC), supported by print bar 408. The processor chip or ASIC outputs electric signals to the dies 26 based upon the control signals received from controller 406. Chip 407 addresses transistor arrays to selectively actuate the fluid droplet ejectors of the dies. The control signals transmitted to the dies cause the fluid, such as ink, to be selectively deposited in a predetermined image or pattern upon the print media 403 moved by media feed 402.

Print bar 408 comprises a structure utilizing one example of the architecture described above with respect to print head 20, 120, 220 and 320. In one implementation, print bar 408 is stationary opposite to media feed 302 to facilitate page wide printing. In another implementation, print bar 408 is carried by a carriage, wherein the carriage is scanned across the media 403 during printing.

Print bar 408 comprises printed circuit board 424 and fluid droplet ejection dies 26. Printed circuit board 424 is similar to printed circuit board 224 described above except that printed circuit board 424 is specifically illustrated as comprising multiple pockets 230 containing multiple dies 26, wherein each of such dies 26 are supported such that outermost faces 42 of dies 26 are recessed within their respective pockets 230 from outermost face 40 of printed circuit board 424. Such recessing provides additional space for electrical interconnects 227 and any covering upon such electrical interconnects 227 without interconnects 227 or their coverings protruding or substantially protruding beyond outermost face 40.

Figure 7:
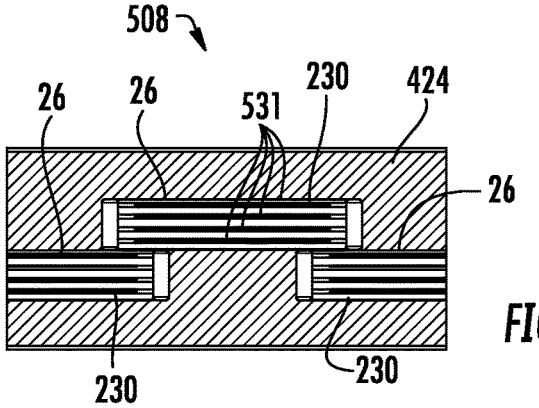
FIG. 7 is a fragmentary plan view of a portion of an example print bar of the printing system of FIG. 6.

FIG. 7 is a bottom view of print bar 508, an example implementation of print bar 408. Print bar 508 may be utilized in printing system 400 in place of print bar 408, wherein print bar 508 also supports processing chip 407. As shown by FIG. 7, print bar 508 comprises printed circuit board 424 having multiple pockets 230 in which are received fluid droplet ejection dies 26. In the example illustrated in FIG. 7, the nozzle plate (in some implementations formed from a material such as Bisphenol A Novolac epoxy (SU8)) are omitted to illustrate the slots 531 of each of dies 26. As further shown by FIG. 7, pockets 230 provided within printed circuit board 424 extend in multiple rows, wherein the pockets 230 of one row are staggered respect to adjacent pockets of another row. In other words, the pockets 230 have end portions that overlap one another in a direction perpendicular to the major dimension or length of each of the pockets. As a result, dies 26 received within such pockets 26 are also staggered with respect to one another and also overlap. Such overlapping enhances printing.

Figure 8:
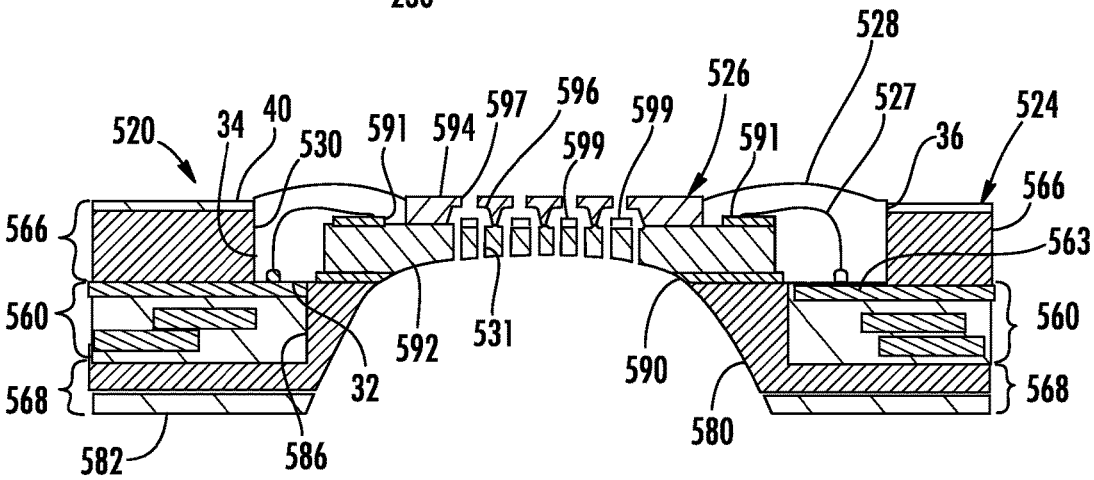
FIG. 8 is a sectional view of a portion of the print bar of FIG. 7.

FIG. 8 is a sectional view illustrating one example print head portion 520 of print bar 508 shown in FIG. 7. Print head portion 520 comprises printed circuit board 524, ink jet die 526, interconnect 527 and encapsulant 528. Printed circuit board 524 comprises core and intermediate binding layer region 560, cover layer 566, cover layer 568, pocket 530 and fluid passage 580. Core and intermediate binding layer region 560 comprises that portion of printed circuit board 524 containing multiple layers or laminations of core layers 260, binding layers 264, electrically conductive traces 262, and electrical vias 265 as illustrated and described above with respect to printed circuit board 224 of FIG. 4.

Cover layer 566 comprises a layer or multiple layers of materials that cover one face of region 560. Cover layer 566 is similar to cover layer 266 described above. In one implementation, cover layer 566 omits electrically conductive traces. In one implementation, cover layer 566 comprises the same material forming binding layers 264. In one implementation, cover layer 566 comprises an epoxy or an epoxy coated glass fabric such as prepreg.

Pocket 530 is similar to pocket 30. Pocket 230 includes floor 32, sides 34 and mouth 36. Although pocket 230 is illustrated as having a single same level floor 32, in other implementations, pocket 32 may comprise a multilevel, multi-tiered or otherwise irregular floor 32. Pocket 530 contains die 26. In the example illustrated, cover layer 568 forms a portion of floor 532. In the example illustrated, die 526 is adhesively secured to the surface of cover layer 568 forming the portion of floor 532.

In the example illustrated, floor of pocket 230 overlies core layer 260A such that pocket 230 does not project into or extend into core layer region 560. Pocket 530 exposes electrical contact pad 563 supported by a core layer a region 560, facilitating the connection of the electrical interconnect 527, a wire or flexible circuit, to contact pad 563 and to die 526. In the example illustrated, electrical interconnect 527 is further covered or coated by a protective layer or layers 527 that formed from a material such as an epoxy.

Cover layer 568 comprises a layer or multiple layers of material extending on a back side of region 560 opposite to that of layer 566. In one implementation, layer 568 omits electrically conductive traces. In one implementation, layer 568 is formed from a material similar to the material forming layer 566. In one implementation, layer 568 is formed from the same material as binding layers 264 of region 560. In one implementation, layer 568 is formed from an epoxy coated glass fabric, such as prepreg.

As further shown by FIG. 8, region 560 defines an opening 586 cover layer 568 which is surrounded by region 560. Opening 586 is aligned with and within the profile of pocket 530. Opening 586 has sides spaced from and within the sides 34 of pocket 530 such that perimeter portions of floor 32 are formed by the underlying region 560 while the central portion of floor 32 is formed by cover layer 568. Cover layer 568 extends into opening 586. In one implementation, cover layer 568 fills opening 586, wherein portions of cover layer 568 within opening 586 subsequently removed to form fluid passage 580. In other implementations, fluid passage 580 is molded into or as part of those portions of cover layer 568 within opening 586.

Fluid passage 580 extends through printed circuit board 524 from a face 582 opposite to face 40. Fluid passage 580 provides a passage by which fluid, such as ink, may be supplied from face 582 through print circuit board 524 to slots, manifold or other fluid delivery passages of die 526. In the example illustrated, until reaching die 526, fluid passage 580 is continuously bounded by or defined by the homogenous material forming cover layer 568 that extends within opening 586, reducing or eliminating the number of lamination junctions or layer junctions along fluid passage 580.

Die 526 is similar to die 26 described above. Adhesive layer 592 bonds died 526 to a surface of cover layer 586 forming a portion of the floor 32 of pocket 530. In the example illustrated, die 526 comprises silicon substrate 592, barrier layer 594 and drop eject is 599. Silicon substrate 592 supports electrical contact pads 591 for electrical connection to printed circuit board 524 by electrical interconnect 527. Silicon substrate 592 further comprises slots 531 that extend through substrate 592, whereby fluid is provided by fluid passage 580 for printing.

Barrier layer 594 cooperates with substrate 592 to form individual firing chambers 596 and provide nozzles 597. In one implementation, barrier layer 594 is formed from a material such as SU8. Each firing chamber 596 contains a drop ejector 599 by which drops of fluid, such as ink, are selectively ejected through the nozzle openings 597. In one implementation, drop injectors 599 comprise thermal fluid droplet ejection resistors. In another implementation, drop injectors 599 comprise other drop ejection mechanisms such as piezo-resistive drop injectors.

Figure 9:
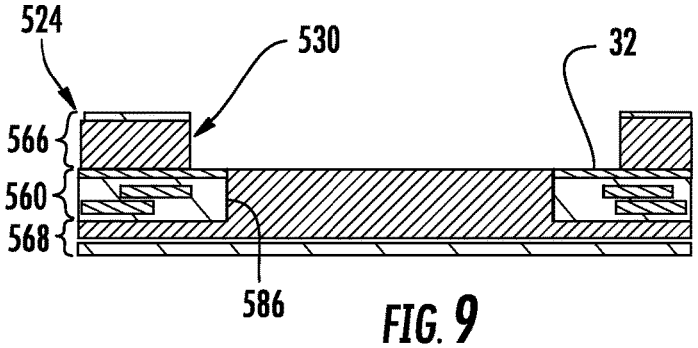
FIGS. 9-13 are sectional views illustrating forming of the portion of the print bar of FIG. 8.

FIGS. 9-13 illustrates one example method for forming print head portion 520 of FIG. 8. As shown by FIG. 9, printed circuit board 524 with pocket 530 is provided. Printed circuit board 524 comprises region 560, cover layer 566 and cover layer 568 as described above. FIG. 9 illustrates cover layer 566 after pocket 530 has been formed within cover layer 566. In one implementation, pocket 530 is molded during the forming of cover layer 566, while cover layer 566 is in a liquid or malleable state, prior to solidification or curing. In other implementations, portions of cover layer 56 are removed, such as by routing, to form pocket 530. In the fabrication state shown in FIG. 9, cover layer 568 fills opening 586 of region 560.

Figure 10:
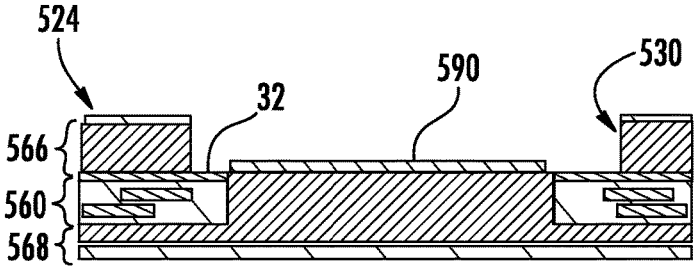
Figures 11, 12, 13, 14, 15, 16, 17:
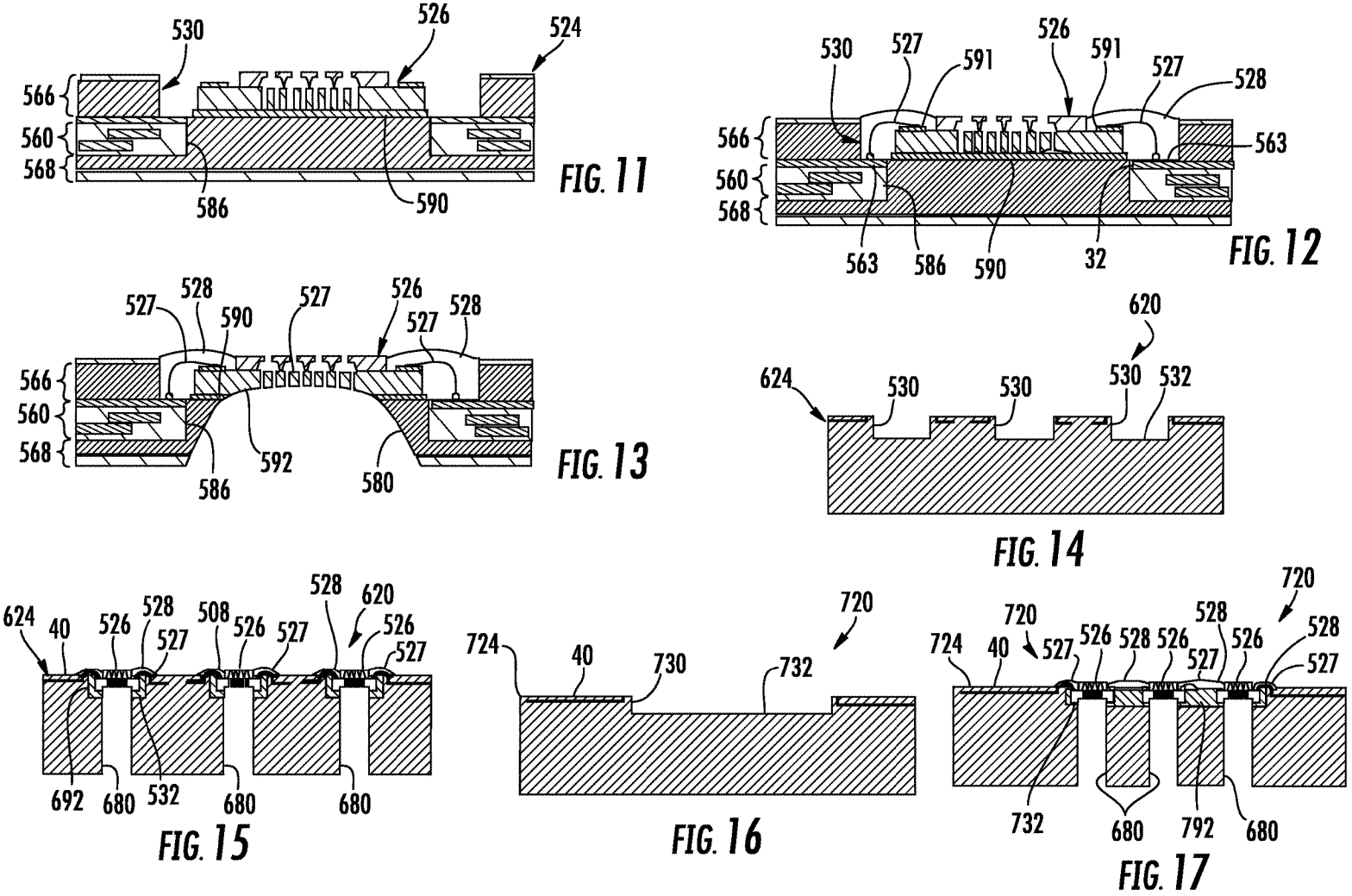
FIGS. 14 and 15 are sectional views illustrating one example of forming of another example print bar.
FIGS. 16 and 17 are sectional views illustrating another example of forming another example print bar.

FIG. 10 illustrates the application or depositing of adhesive layer 590 upon cover layer 560 which extends at the bottom of pocket 530 to form a portion of floor 32. FIG. 11 illustrates the attachment of die 526 within pocket 530 using the previously applied adhesive layer 590. FIG. 12 illustrates wire bonding of electrical interconnect 527 to contact pads 563 of printed circuit board 524 and to contact pads 591 of die 526. As shown in FIG. 12, electrical interconnects 527 are further encapsulated by a dielectric encapsulant 528 such as an epoxy.

FIG. 13 illustrates the forming of fluid passage 580 through cover layer 568 within opening 586. Fluid passage 580 extends into substrate 592 of die 526 such that slots 531 are brought into connection with fluid passage 580. In one implementation, fluid passage 580 is formed by material removal, such as with a plunge cut by a router. In other implementations, fluid passage 580 may be formed for other material removal processes. In still other implementations, fluid passages 580 may be molded into cover layer 568 while the material a cover layer 568 is in a liquid or malleable state, similar to the molding of pocket 530. In such an implementation, adhesive layer 590 is instead formed upon those portions of floor 32 provided by the uppermost layer of region 560.

FIGS. 14 and 15 illustrate the forming of another example print head portion 620 of print bar 508 shown in FIG. 7. As shown in FIG. 15, which illustrates the completed printed portion 620, print head portion 620 comprises printed circuit board 624, ink jet dies 526, interconnects 527 and encapsulants 528. As shown by FIG. 14, printed circuit board 624 is similar to printed circuit board 524 except that printed circuit board 624 comprises multiple spaced pockets 530. In one implementation, the multiple spaced pockets 530 are formed with a router as part of printed circuit board fabrication process or created by gang sawing the finished printed circuit board 524.

As shown by FIG. 15, each pocket 530 is filled with an adhesive 692 prior to positioning of dies 526 within their respective pockets 530. In the example illustrated, each die 526 is surrounded by an adhesive on its backside and all edges for enhanced adhesion. In the example illustrated, the depth of each recess pocket 530 may be varied to reduce the overall die protrusion from the outermost surface 40 of print head die 624.

Once each die 526 has been position within its associated pocket 530, wire bonding with electrical interconnects 527 is performed and encapsulant 528 is applied over electrical interconnects 527. Thereafter, backside fluid slots or fluid passages 680 are formed. Fluid passages 680 extend through the floors 532 of pockets 530 to connect fluid passages 680 to slots 531 of each of dies 526. In one implementation, such backside fluid passages 680 are formed with a plunge cut sawing or a laser. In one implementation, such fluid passages 680 are coated with a barrier layer 284 such as described above with respect print head 220 in FIG. 4. In another implementation, such fluid passages 680 are provided with a tube or liner. It still other implementations, printed circuit board 624 is fabricated such that one of its laminated layers defines the sides of fluid passage 680 along its length, similar to cover layer 568 extending along or defining fluid passage 580.

FIGS. 16 and 17 illustrate the forming of another example print head portion 720 of print bar 508 shown in FIG. 7. As shown in FIG. 17, which illustrates the completed print head portion ink jet dies 526 interconnects 527 and encapsulants 528. As shown by FIG. 16, printed circuit board 724 is similar to printed circuit board 524 except that printed circuit board 724 comprises a single large pocket 730 in which multiple dies 526 are to be located. In one implementation, pocket 730 is formed with a router as part of printed circuit board fabrication process or created by gang sawing the finished printed circuit board 724.

As shown by FIG. 17, pocket 730 is filled with an adhesive 792 prior to positioning of dies 526 within the one pocket 730. In the example illustrated, each die 526 is surrounded by an adhesive on it backside and all edges for enhanced adhesion. In the example illustrated, the depth of pocket 730 may be varied to reduce the overall die protrusion from the outermost surface 40 of print head die 724.

Once each die 526 has been positioned within pocket 730, wire bonding with electrical interconnects 527 is performed. Encapsulant 528 is formed so as to encapsulate electrical interconnects 527. Thereafter, backside fluid slots or fluid passages 680 are formed. Each fluid passage 680 extends through the floor 732 to connect fluid passages 680 to slots 531 of each of dies 526. In one implementation, such backside fluid passages 680 are formed by plunge cut sawing or a laser. In one implementation, such fluid passages 680 are coated with a barrier layer 284 such as described above with respect print head 220 in FIG. 4. In another implementation, such fluid passages 680 are provided with a tube or liner. It still other implementations, printed circuit board 724 is fabricated such that one of its laminated layers defines the sides of fluid passage 680 along its length, similar to cover layer 568 extending along or defining fluid passage 580.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. An apparatus comprising:
a printed circuit board comprising a recessed pocket; and
a fluid droplet ejection die within the recessed pocket, wherein the printed circuit, board comprises:
a first core layer;
first electrically conductive traces on the first core layer;
a second core layer;
second electrically conductive traces on the second core layer; and
a binding layer joining the first core layer to the second, core layer.

2. The apparatus of claim 1, wherein the recessed pocket extends into a face of the printed circuit board and wherein the fluid droplet ejection die has a face substantially flush with the face of the printed circuit board.

3. The apparatus of claim 1, wherein the recessed pocket extends into a face of the printed circuit board that faces in a first direction and wherein the fluid droplet ejection die has a face facing in the first direction and recessed within the recessed pocket.

4. The apparatus of claim 1 further comprising a second fluid droplet ejection die within the recessed pocket.

5. The apparatus of claim 1, wherein the printed circuit board comprises a second recessed pocket having a second floor, the apparatus further comprising a second fluid droplet ejection die supported within the second recessed pocket.

6. The apparatus of claim 1, wherein the recessed pocket has a depth of at least 150 μm.

7. The apparatus of claim 1, wherein the recessed pocket extends into a first face of the printed circuit board and wherein the printed circuit board further comprises a fluid passage extending into a second face of the printed circuit board, the fluid passage being connected to slots of the fluid droplet ejection die.

8. The apparatus of claim 1 further comprising a processing chip supported by the printed circuit board that is connected to transistor arrays to drive the transistor arrays.

9. The apparatus of claim 1, wherein the recessed pocket has a floor with an electrical contact pad directly on the floor within the pocket, the electrical contact pad being electrically connected to the fluid droplet ejection die.

10. A printed circuit board for use with a fluid droplet ejection die having a thickness, the printed circuit board comprising:
a recessed pocket having a floor and sized to receive the fluid droplet ejection die and having a depth greater than or equal to 150 micrometers; and
an electrical contact pad on the floor, wherein the contact pad is exposed within the recessed pocket.

11. The printed circuit board of claim 10, wherein the printed circuit board comprises:
a first core layer;
first electrically conductive traces on the first core layer;
a second core layer;
second electrically conductive traces on the second core layer; and
a binding layer joining the first core layer to the second core layer.

* * * * *